US006918195B2

(12) United States Patent
Fleissner

(10) Patent No.: US 6,918,195 B2
(45) Date of Patent: Jul. 19, 2005

(54) DRUM DEVICE WITH PERMEABLE DRUM JACKET AND WIRE GAUZE MOUNTED THEREON UNDER PRETENSION

(75) Inventor: Gerold Fleissner, Zug (CH)

(73) Assignee: Fleissner GmbH & Co., Maschinenfabrik, Egelsbach (DE)

( * ) Notice: Subject to any disclaimer, the term of this patent is extended or adjusted under 35 U.S.C. 154(b) by 0 days.

(21) Appl. No.: 10/469,855

(22) PCT Filed: Mar. 1, 2002

(86) PCT No.: PCT/EP02/02238

§ 371 (c)(1),
(2), (4) Date: Feb. 27, 2004

(87) PCT Pub. No.: WO02/086235

PCT Pub. Date: Oct. 31, 2002

(65) Prior Publication Data

US 2004/0134089 A1 Jul. 15, 2004

(30) Foreign Application Priority Data

Mar. 8, 2001 (DE) ..... 101 11 335

(51) Int. Cl.[7] ..... F26B 13/00
(52) U.S. Cl. ..... 34/620; 34/629; 492/48
(58) Field of Search ..... 31/114, 115, 128, 31/620, 629, 637; 429/22, 42, 47, 48

(56) References Cited

U.S. PATENT DOCUMENTS

| | | | | | |
|---|---|---|---|---|---|
| 3,452,414 | A | * | 7/1969 | Schiel | 492/22 |
| 3,510,959 | A | * | 5/1970 | Fleissner | 34/115 |
| 4,237,592 | A | * | 12/1980 | Kuge et al. | 492/25 |
| 4,625,376 | A | * | 12/1986 | Schiel et al. | 492/26 |
| RE33,034 | E | * | 8/1989 | Schiel et al. | 241/119 |

* cited by examiner

*Primary Examiner*—Denise L. Esquivel
*Assistant Examiner*—Kathryn S. O'Malley
(74) *Attorney, Agent, or Firm*—Antonelli, Terry, Stout & Kraus, LLP

(57) ABSTRACT

It is known from the art to mount a wire gauze (10) onto a drum (1) with a permeable drum jacket (8) under pretension, for example, for allowing air to flow through a web of material placed on said drum, said wire gauze optionally being disposed even at a distance to the drum jacket surface. The air thus flows more evenly across the surface of the web of material and no visible marks on the web of material, caused by the contact of the web with the intermediate space between the holes of the drum, occur. The wire gauze has to be elastically fastened on the front faces of the drum to compensate also for thermal stresses. According to the invention, preferably U-shaped spring elements (11) extending radially to the axis of the drum are fastened on the front face of the drum and on a tensioning ring (13) for the gauze provided on the level of the drum outer diameter.

8 Claims, 2 Drawing Sheets

Figure 1:
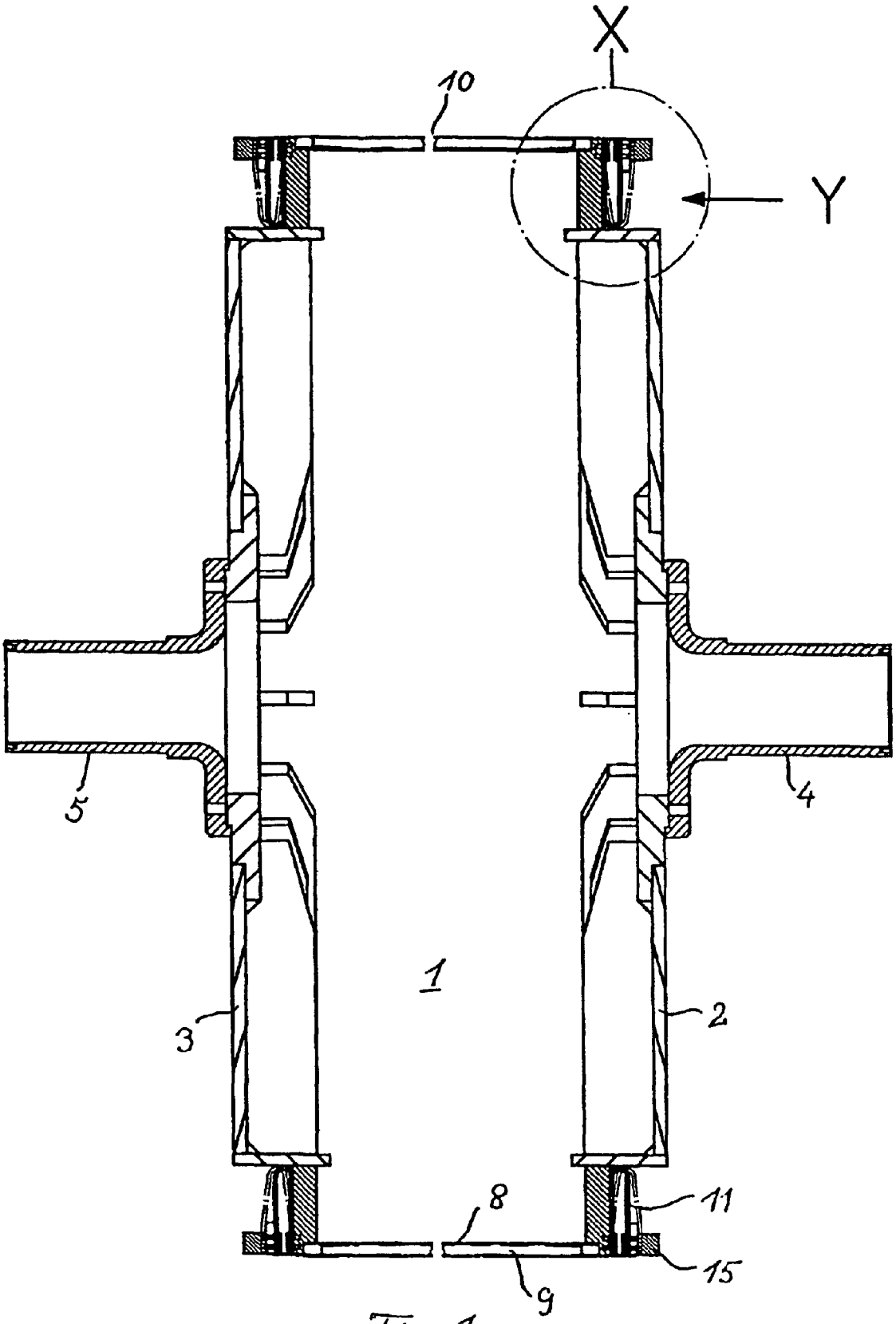

DRUM DEVICE WITH PERMEABLE DRUM JACKET AND WIRE GAUZE MOUNTED THEREON UNDER PRETENSION

The invention relates to a drum device, preferably, a screening drum, for the flow-through heat treatment of web-type textile material, nonwoven material, or paper, including a treatment agent, such as a gaseous treatment agent, circulating in the device, and including a sheet-metal drum which is internally under suction, has bases at the end faces and is perforated, for example, for permeability, and functions as the transport element for the web-type material, the circumference of which drum is covered by a permeable, tube-like screen fabric, the at least one circular front edge of which is elastically supported by a tension ring of the outer diameter of the drum and arranged concentrically, said ring being located at the associated front wall of the drum so as to continuously compensate for any changes in length of the screen fabric alternately arising from temperature fluctuations during the heat treatment.

A device of this type was disclosed by German Patent AS-1729487. The tension ring is composed of a V-ring, the outer diameter of which matches that of the screening drum and is attached to the screen fabric. Spiral springs resting on the opposite base wall of the screening drum are directed toward the perpendicularly aligned front wall of the tension ring, by which springs the tension ring pulls the screen fabric taut over the drum. Since the spiral springs do not exert any force radially, the tension ring must be held in position by rigid adjustment bolts attached to the screening drum base, over which bolts the tension ring slides axially.

In practice, this retention arrangement of the tension ring has proven to be subject to considerable wear. The adjustment bolts are placed under bending stress by the differential thermal expansion of the tension ring relative to the screening drum, and this effect cannot be compensated by radial oblong holes in the tension ring. The result is that there is wear in the front wall of the tension ring until the point that the adjustment bolts break.

The idea might occur to support the tension ring on the shaft of the drum, as indicated in French Patent 1430928, or to pull the screen fabric radially inwards over the tension ring, as in German Patent AS 1297978, and attach it there by radially aligned spiral springs to a ring mounted on the shaft of the drum. One consequence of the solution according to the French patent, in addition to a greater mass for the tension ring which is especially disadvantageous for large drums, is the friction of the tension ring on the drum shaft or on the outer diameter of the suction port; while the solution according to the German AS is eliminated by the fact that the screen fabric is always pulled over the radially outer tensioning edge of the tension ring during the continuous expansion compensation in operation—an effect which eventually destroys the fabric at this location.

The goal of the invention is to find an elastic tensioning attachment for a screen fabric wound onto a drum, which tension attachment also compensates for radial forces on the tension ring caused by alternately occurring thermal expansion forces.

Based on the device of the type referred to at the outset, the invention achieves the goal by retaining the tension ring using radially oriented but axially effective spring elements located concentrically relative to its outer diameter and radially at the level of the outer diameter of the drum. In other words, the spring elements do not draw the screen fabric over the edge of the tension ring, yet remain radially oriented. The reason for this approach lies in the advantage provided by these spring elements whereby radially oriented spring elements are in fact able to accommodate the radially produced forces that previously caused the destructive wear. In this device, only the axial forces on the screen fabric remain effective, and specifically, only those forces that uniformly act circumferentially on the screen fabric through the tension ring. Any uneven circumferential load on the screen fabric is thus eliminated, even during operation of the drier. Elements subject to wear are no longer present since this type of spring element does not undergo any wear.

In selecting spring elements of this type, leaf springs may be considered which are attached, for example, oriented radially inwards on the drum base. Spring elements which have a greater width, that is, are of a fillet-like shape, are advantageous here. This form allows radially acting forces to be accommodated by the radially oriented fillets, as with spokes of a wheel, from the base of the drum. As a result, the tension ring is also supported radially, while remaining axially movable—and specifically in such a manner that no type of friction, and thus wear, is produced.

Especially advantageous are spring elements fabricated from a flat spring steel which are bent into a U-shape, and in which the spring tension lies in the particular opening of the U-shaped expansion. The closed end of the U-shaped spring is thus oriented radially inwards, while the two radially outward legs of the spring are expanded axially—as viewed in the direction of the drum shaft. One leg is attached to the drum base and the other to the tension ring on which in turn the screen fabric is held, for example, by a clamping ring.

A example of the device of the type according to the invention is illustrated in the drawings.

Figure 2:
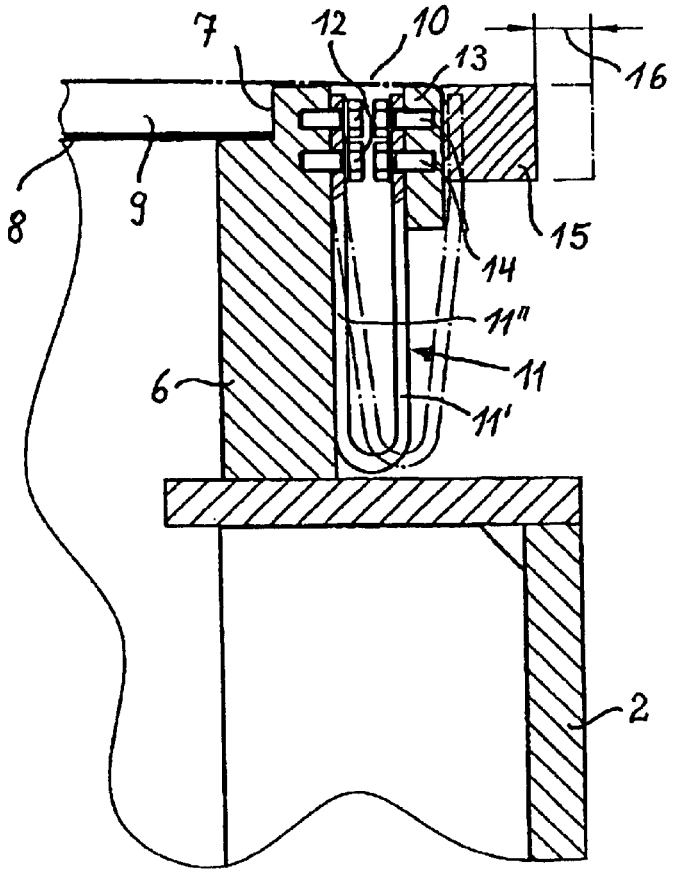
Figure 3:
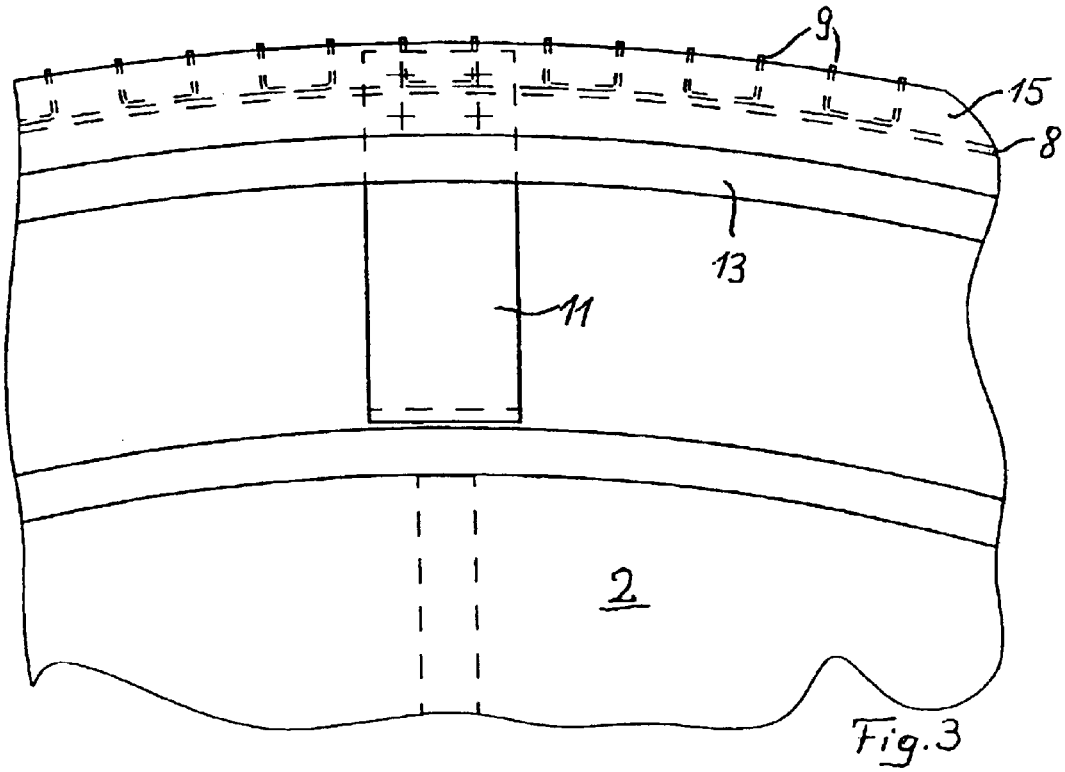

FIG. 1 is a cross-section of a roller with the two drum bases, and located between these, a perforated drum shell with U-shaped spacers oriented radially outward for the screen fabric surrounding the drum, FIG. 2 is an enlarged view of detail X according to FIG. 1, and FIG. 3 shows detail X according to FIG. 2 as viewed along the Y axis.

The screening drum device essentially corresponds to the device of German Patent A-19525459. A conventional screening drum device is fundamentally composed of a rectangular housing, not shown here, which is subdivided into a treatment section and a fan section. The screening drum 1 is mounted in the treatment section, while a fan is rotatably mounted in the fan section. The fan section may, of course, also be located in a dedicated fan housing, also not shown here, which is separate from the screening drum housing. In any case, the fan creates suction in the interior of drum 1.

Screening drum 1 is composed of two drum bases 2 and 3 which have a concentric hollow shaft 4, 5 through which suction is generated in the interior of drum 1. The stable drum bases 2, 3 have an annular disk 6 of simpler design oriented radially outward, which disk is permanently welded to the particular base 2, 3. Axially inwards from drum 1, these annular disks 6 bear the perforated drum shell 8 in a corresponding annular groove 7, on which shell the U-shaped spacers 9, more clearly evident in FIG. 3, are attached for the externally drawn tubular screening fabric 10. Spacers 9 rest with their radially inward surface lying on screening drum shell 8 at a predefined distance adjacent to each other. The screen-type liner 10 in turn rests only on the radially outward facing edges of U-shaped spacers 9, thereby ensuring a uniform flow through the material resting on screen fabric 10.

Screen fabric 10 is attached elastically and axially taut on drum bases 2, 3, or on annular disks 6. The U-shaped spring elements 11 having a greater width, visible in FIG. 3, perform this function. Spring elements 11 are fabricated from a spring steel, bent into a U-shape, and thus have two legs 11' and 11" of equal length that spread obliquely apart in the untensioned state (see broken lines). The spring tension of the spring elements 11 thus lies in the corresponding expansion 16 of these two legs 11' and 11".

To provide the tensioned attachment of screen fabric tube 10, spring elements 11 are aligned with their closed ends oriented radially to the drum shaft. One radially outward facing leg 11" of spring element 11 is attached by screws 12 to annular disk 6, and thus to drum base 2, 3; while other leg 11' is attached by appropriate screws 14 to the annular disk 13 for screen fabric 10. Attachment of spring elements 11 to the drum base and to tension ring 13 is at the same level. An additional necessary component located axially outside the tension ring is the clamping ring 15 which may also be composed of ring segments, and which functions to clamp and hold the rim of screen fabric 10 in the gap between the clamping ring and tension ring.

In order to tension screen fabric 10, the spring elements are compressed by the entire spring deflection 16 using an auxiliary tool not shown, and clamping ring 15 is securely attached by screws or the like to tension ring 13, with screen fabric 10 between these components. When the auxiliary tool is released, the screen fabric is tensioned so as to rest securely on the fillets of U-shaped spacers 9. In response to heat-related changes in the tensioning state occurring during operation, the spring elements compensate for these changes in both the axial and radial axes.

What is claimed is:

1. Drum device, preferably, a screening drum, for the flow-through heat treatment of web-type textile material, nonwoven material, or paper, including a treatment agent, such as a gaseous treatment agent, circulating In the device, and including a sheet-metal drum which is internally under suction, has bases at the end faces and is perforated, for example, for permeability, and functions as the transport element for the web-type material, the circumference of which drum is covered by a permeable, tube-like screen fabric, the at least one circular front edge of which is elastically supported by a tension ring of the outer diameter of the drum and arranged concentrically, said ring being located at the associated front wall of the drum so as to continuously compensate for any changes in length of the screen fabric alternately arising from temperature fluctuations during the heat treatment, characterized in that the tension ring (13) is held radially at the level of the outer diameter of the drum (1) and concentrically relative to the outer diameter by radially oriented but axially effective spring elements (11).

2. Device according to claim 1, characterized in that the spring elements (11) are designed to be laterally wider as compared to their perpendicular dimension.

3. Device according to claim 1, characterized in that the spring elements (11) have a certain width, that is, are of a fillet-like shape.

4. Device according to claim 1, characterized in that the spring elements (11) are bent in a U-shape, and the spring tension lies in the particular opening (16) of their U-shaped expansion.

5. Device according to claim 1, characterized in that the spring elements (11) are fabricated from a flat spring steel.

6. Device according to claim 1, characterized in that the spring elements (11) are attached on one side directly to the wall of the drum base (6), and on the other side to the tension ring (13).

7. Device according to claim 6, characterized in that attachment of the spring elements (11) is provided at the same radial level by, for example, screws (12; 13) on one side to the base (6) of the drum (1), and on the other side to the tension ring (13).

8. Device according to claim 1, characterized in that the one leg (11") of the spring element (11) at least partially rests radially against the drum base (6), while the other leg (11') is movable axially outward with the tension ring (13).

* * * * *